US007044818B2

(12) United States Patent
Askins

(10) Patent No.: US 7,044,818 B2
(45) Date of Patent: May 16, 2006

(54) SWIM STROKE GUIDE

(75) Inventor: Craig Askins, P.O. Box 130462, Ann Arbor, MI (US) 48113

(73) Assignee: Craig Askins, Ann Arbor, MI (US)

( * ) Notice: Subject to any disclaimer, the term of this patent is extended or adjusted under 35 U.S.C. 154(b) by 0 days.

(21) Appl. No.: 10/943,432

(22) Filed: Sep. 18, 2004

(65) Prior Publication Data

US 2006/0063446 A1 Mar. 23, 2006

(51) Int. Cl.
*A63B 69/10* (2006.01)

(52) U.S. Cl. ..... 441/55; 434/254; 482/55; 482/56

(58) Field of Classification Search ..... 441/55, 441/56, 57, 58, 59, 65, 129; 482/51, 55, 482/56; 434/254, 255
See application file for complete search history.

(56) References Cited

U.S. PATENT DOCUMENTS

| | | | | | |
|---|---|---|---|---|---|
| 964,886 | A | * | 7/1910 | Sickels | 482/56 |
| 1,843,617 | A | * | 2/1932 | Marshall | 441/55 |
| 3,085,356 | A | * | 4/1963 | Wayfield | 434/254 |
| 3,124,815 | A | * | 3/1964 | Harvey | 441/55 |
| 4,640,268 | A | | 2/1987 | Roberts | |
| 4,674,740 | A | | 6/1987 | Iams et al. | |
| 4,830,363 | A | | 5/1989 | Kennedy | |
| 5,029,848 | A | | 7/1991 | Sleamaker | |
| 5,158,513 | A | | 10/1992 | Reeves | |
| 5,241,952 | A | | 9/1993 | Ortiz | |
| 5,354,251 | A | | 10/1994 | Sleamaker | |
| 5,540,591 | A | | 7/1996 | Doane | |
| 5,634,834 | A | * | 6/1997 | Cole et al. | 441/65 |
| 6,142,843 | A | * | 11/2000 | Haase | 441/129 |
| 6,142,912 | A | | 11/2000 | Profaci | |
| 6,352,493 | B1 | | 3/2002 | Davis | |
| 6,743,023 | B1 | | 6/2004 | Topolski | |
| 6,764,431 | B1 | | 7/2004 | Yoss | |

OTHER PUBLICATIONS

Ernest Maglischo, Swimming Fastest, Feb. 2003 Human Kinetics Publishers, Champaign, IL, USA.

* cited by examiner

*Primary Examiner*—Lars A. Olson
(74) *Attorney, Agent, or Firm*—Milbank, Tweed, Hadley & McCloy LLP

(57) ABSTRACT

An exercise apparatus and method for training swimmers. The device is a guide (10) of substantially rigid shape. It is used to teach and condition the swimmer's upper body. As a swimmer traces the perimeter of the guide with his arm in a manner as if he were swimming, the swimming techniques of high elbow catch and high elbow stroke path are executed. The device will enable a swimmer to train form in a template like manner. It can also be combined with resistive means to train strength at the same time as training form.

18 Claims, 9 Drawing Sheets

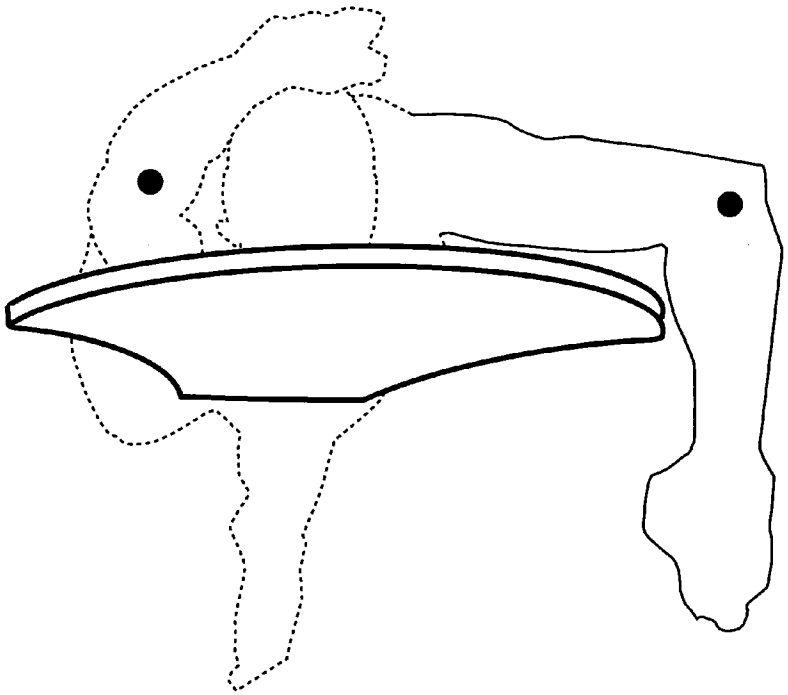
FIG. 7a
FIG. 7b
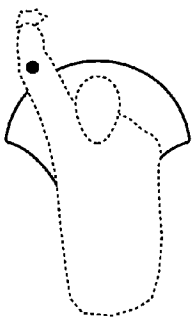
FIG. 7c
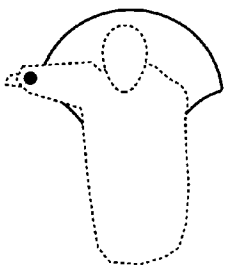
FIG. 7d
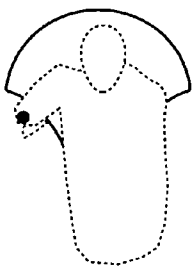
FIG. 7e
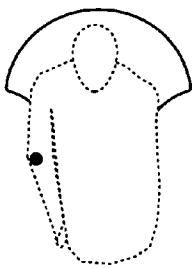
FIG. 7f

SWIM STROKE GUIDE

TECHNICAL FIELD OF THE INVENTION

This invention generally relates to an apparatus used as a means for teaching the various swimming strokes. Additionally, this invention relates to an apparatus used while conditioning the muscles used in the various swimming strokes. The invention specifically relates to a guide used to train the upper body movements of efficient swimming.

BACKGROUND OF THE INVENTION

Over the years the swim coaching community has refined its analytical tools and is better able to study the most elite swimmers and detect techniques that improve propulsion and/or minimize resistance. These techniques are adopted and incorporated into the teaching and training models for further advances in the sport. Over the last twenty years advances have been made from a straight-arm windmill type stroke to a sculling "s" pattern and most recently to techniques coined High Elbow Catch and High Elbow Stroke Path. Examples of the most recent techniques are described in U.S. Pat. No. 6,743,023 issued to Topolski. The aim of his invention urges high elbow technique. It is only potentially effective when used in the water due to buoyancy. Many athletic advances are made by improved conditioning of the specific muscles used to perform the desired sports movement, as noted in the last paragraph of the summary of U.S. Pat. No. 5,951,443 issued to Askins. The concept of training specificity applies to out-of-water swim training apparatus as disclosed in several swim bench U.S. Patents:

| | | |
|---|---|---|
| 4,674,740 Iams, et al. | 5,158,513 Reeves | 6,142,912 Profaci |
| 4,830,363 Kennedy | 5,354,251 Sleamaker | 6,352,493 Davis |
| 5,029,848 Sleamaker | 5,540,591 Dame | 6,746,431 Yoss |

In particular Doane states the use of rubber tubing as a resistive mechanism. He concedes the advantage of tubing is simple implementation and its technical drawback "is that it provides no simulation of the relationship between force and the cube of hand velocity believed to exist in swimming." All the swim bench examples above provide various types of resistive forces for conditioning swimmers in a simulated swim situation. However, none of the examples address the techniques named in Topolski which are substantiated by biomechanist Ernest W. Maglischo in his publication, Swimming Fastest, Pub. 2/2003. The advantages of the two techniques are as follows. The High Elbow Catch shortens the arm lever so the hand and inner forearm push water backwards earlier in the stroke cycle than the traditional dropped elbow catch. This creates propulsive forces for a longer period each stroke cycle. When the arm is in a dropped elbow posture it relies predominantly on the chest and shoulder muscles. The High Elbow Stroke Path places the arm in a position to more effectively engage the latissimus dorsi and back muscles. Engaging the latissimus dorsi and back muscles in addition to the chest and shoulders creates a more powerful arm stroke.

The High Elbow Stroke Path should not be confused with the concept of high elbow recovery which is the path of the arm after it leaves the water to the re-entry of the water.

A common error of training the swim stroke out-of-water is not accounting for the natural body roll that occurs in water. Duplicating the body roll of swimming while out-of-water especially in the prone position is very difficult due to many factors including buoyancy and gravity. Many of the prior art swim bench apparatus attempt to simulate body roll but do so in convoluted manner. Although this factor needs to be considered in out-of-water training, it can be simply accomplished by guiding the arm in a path relative to the swimmer's shoulder plane, not the pool bottom or water surface.

U.S. Pat. No. 4,640,268 issued to Roberts and U.S. Pat. No. 5,241,952 issued to Ortiz disclose mechanisms to guide the appendages or the hand in a set pattern. Neither easily adapt nor are designed to accomplish the three dimensional movement necessary for the desired swim pattern technique.

SUMMARY OF THE INVENTION

The present invention provides a device for teaching stroke techniques of the various competitive swim strokes, namely Freestyle, Butterfly, Backstroke, and Breaststroke. An objective of the invention is to guide the swimmer's hand, elbow, arm, and shoulder through a stroke path that enhances stroke efficiency. It is also the objective of the invention to engage hand, arm, and shoulder muscles along with chest and back muscles in a specific manner conducive to efficient swimming.

It is the objective of the invention to promote two primary factors in the swim strokes when training out-of-water. The first identified as High Elbow Catch and the second as High Elbow Stroke Path. The High Elbow Catch positions the hand and inner forearm to push water backwards, opposite the swim direction, early in the stroke cycle. This creates propulsive forces for a longer period each stroke cycle. When the arm is in a dropped elbow posture it relies predominantly on the chest and shoulder muscles. The High Elbow Stroke Path places the arm in a position to more effectively engage the latissimus dorsi and back muscles. Engaging the latissimus dorsi and back muscles in addition to the chest and shoulders creates a more powerful propulsive force.

It is the objective of the invention to provide not only a guide for form, but a guide for form that can be used while training with resistive means to increase strength. Many swimmers utilize resistive devices out-of-water to develop strength. Many swimmers utilize resistive devices out-of-water to develop strength. As previously mentioned, the more specific a training exercise, the more effective the training. The advantage of this invention is it provides a simple means of form and resistance training.

Another objective of the invention is to provide a template to guide the swimmers hand, elbow and shoulder in a path relative to the swimmers shoulder plane, a method that effectively compensates for the absence of body roll that occurs in out-of-water training.

Another objective of the invention is provide a guide made sufficiently flexible as to not prevent a dropped elbow, but when the undesired dropped elbow occurs flexing the guide the swimmer is immediately reminded that the stroke path is improper. The advantage of this flexible construction is to alert the swimmer to the undesired movement and allow self-correction. In some instances the guide should be completely rigid in order to reprogram or break a pattern when the swimmer is incapable of self-correction.

Another objective of the invention is to provide an assortment of shapes and sizes to accommodate various body types.

BRIEF DESCRIPTION OF THE DRAWINGS

FIG. 7 shows the swimmer's elbow position using the guide

DESCRIPTION OF THE PREFERRED EMBODIMENT

Figure 1:
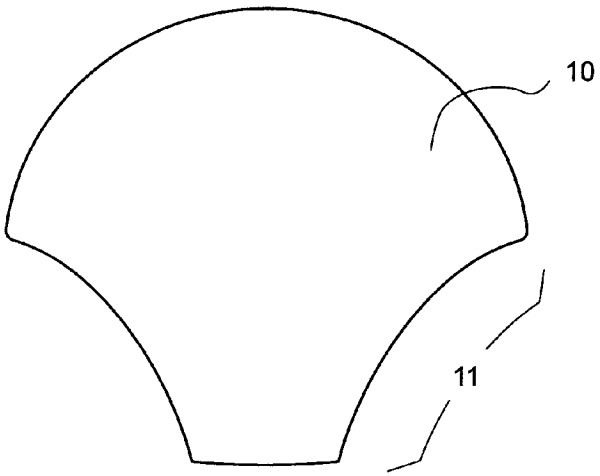
FIG. 1 shows the swim training guide

FIG. 1 (top view) depicts the preferred embodiment of a guide (10) constructed with foamed PVC board. It may be constructed from a variety of materials including wood, plastic, aluminum, or metal. The guide's cut-away shape (11) allows a swimmer to finish each stroke near the torso.

Figure 2:
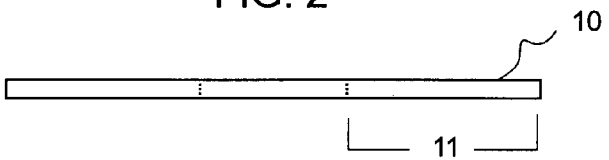
FIG. 2 shows the side view of the swim training guide

FIG. 2 (side view) depicts the preferred embodiment of the guide (10). The thickness of the preferred guide is 3 mm to allow some flexibility during use, although it may be less or more thick as constructed from various materials.

Figure 3:
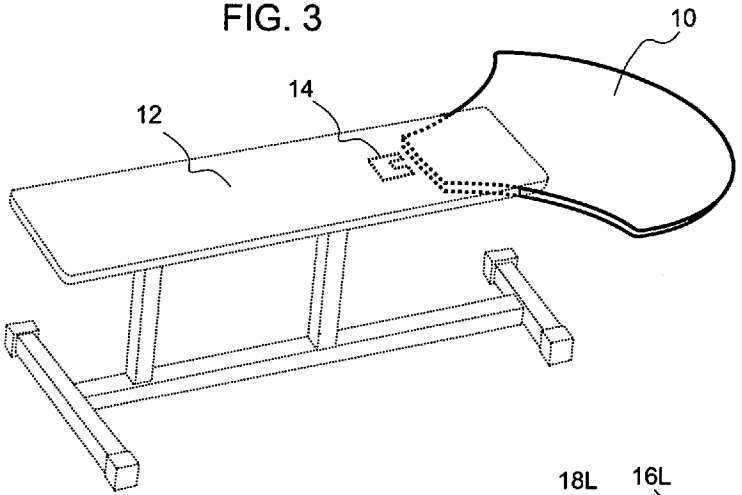
FIG. 3 shows the guide as attached to a bench

FIG. 3 depicts the guide (10) attached to a bench (12) by means of ordinary screws or may include hardware such as a clamp or bracket (14) to allow the guide to be easily removable.

Figure 4:
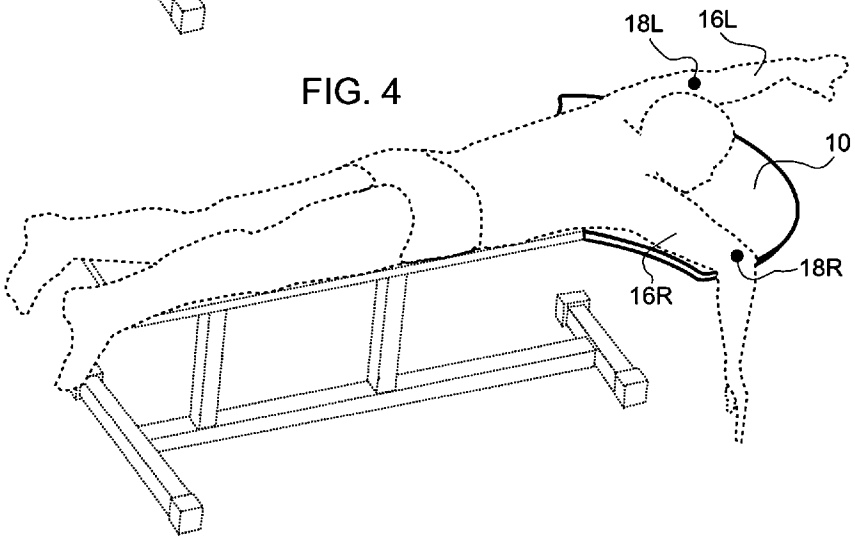
FIG. 4 shows a swimmer while using the guide

FIG. 4 depicts a freestyle swimmer in position to utilize the guide where the left arm (16L) is in the glide position ready to begin the High Elbow Catch and the right arm (16R) is mid-stoke illustrating how the guide keeps the arm in the High Elbow Stroke Path. The elbow joints of the swimmer are represented by dots (18L) and (18R) respectively.

Figure 5:
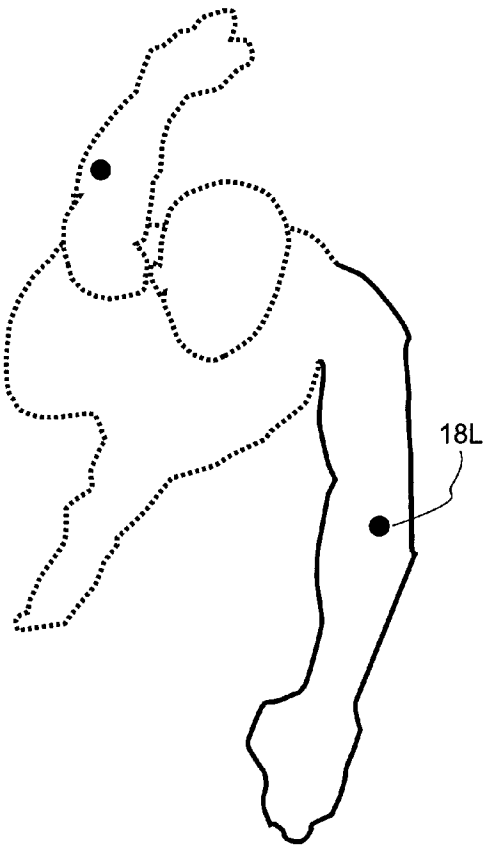
FIG. 5 shows a dropped elbow swim stroke

FIG. 5 depicts a freestyle swimmer without the guide in a dropped elbow stroke (18L). The guide (10) is made flexible as not to prevent a dropped elbow, but when the undesired dropped elbow bends the guide the swimmer is immediately reminded that the stroke path is improper. The degree of flexibility may vary with material, but the purpose is to have the swimmer self correct the error, not to have the mechanism force the path of the stroke. In some instances the guide (10) should be completely rigid.

Figure 6:
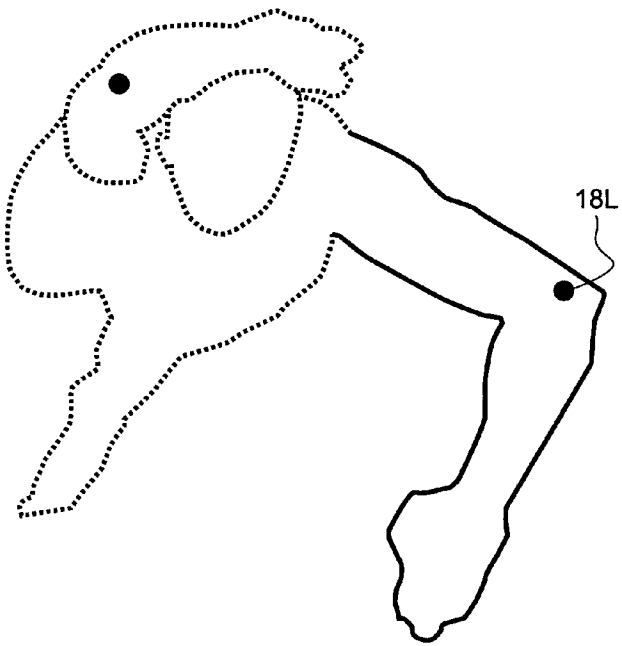
FIG. 6 shows a high elbow swim stroke

FIG. 6 depicts a freestyle swimmer without the guide in a High Elbow Stroke Path (18L).

FIG. 7 series depicts how the guide requires a freestyle swimmer to maintain a high elbow position throughout the stroke. The glide position is shown in (7*b*). The High Elbow Catch, where the swimmer's palm and forearm engage the water in a backward motion early in the stoke cycle is shown in (7*c*). The power phase of the stroke where the swimmers uses the palm, forearm and underside of the bicep/triceps to push backwards on the water is shown in (7*d*). This is the phase of the stroke where the High Elbow Stroke Path allows the swimmer to engage more effectively the latissimus dorsi and back muscles along with the shoulder and chest muscles for an optimally powerful stroke. The purpose of the cut-away design (11) allowing a swimmer to finish each stroke is shown in (7*e*) and (7*f*).

Figure 8:
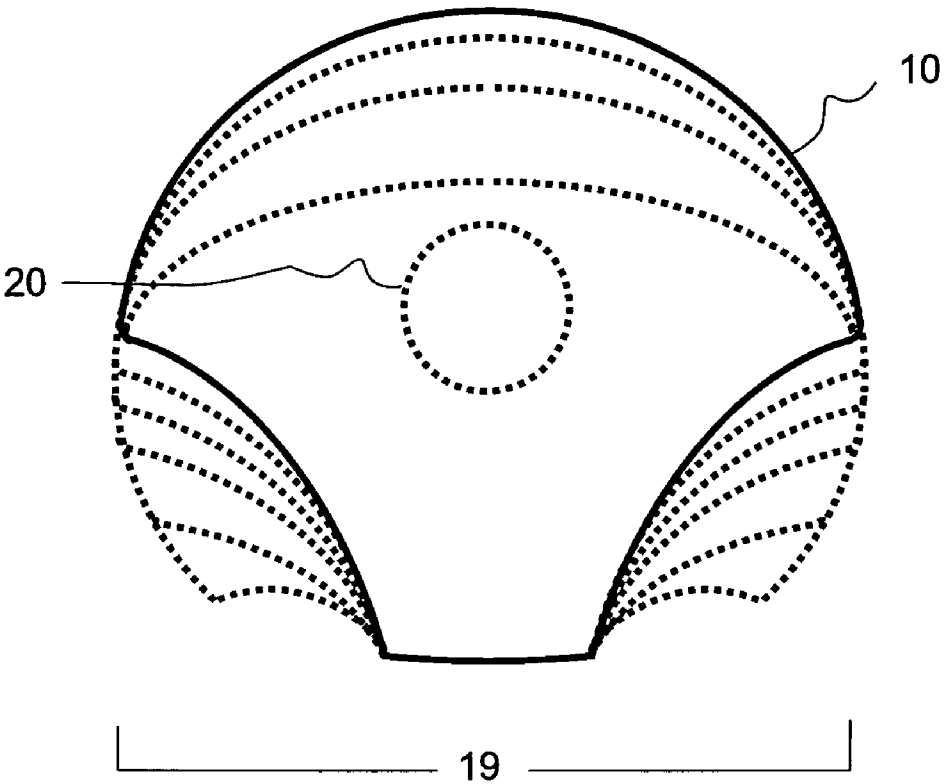
FIG. 8 shows various shapes of the guide

FIG. 8 depicts several shape variations of the preferred embodiment of the guide (10) to accommodate various arm lengths, body shapes and individual technique preferences. The horizontal measurement (19) of the guide (10) will be sized to the elbow-to-elbow span of the individual swimmer. An optional cut away center (20) in the guide (10) may accommodate more air flow for breathing when the guide is being used.

Figure 9:
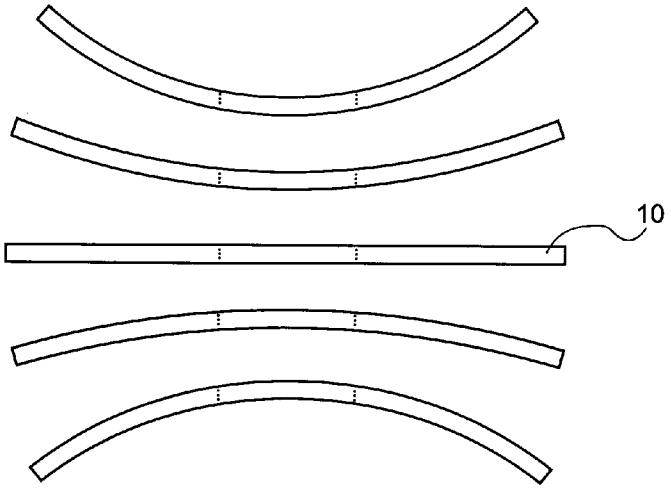
FIG. 9 shows concave and convex guides

FIG. 9 depicts several variations of concave and convex shapes that may be bent or molded into the guide (10) to accommodate individually preferred stroke technique.

Figure 10:
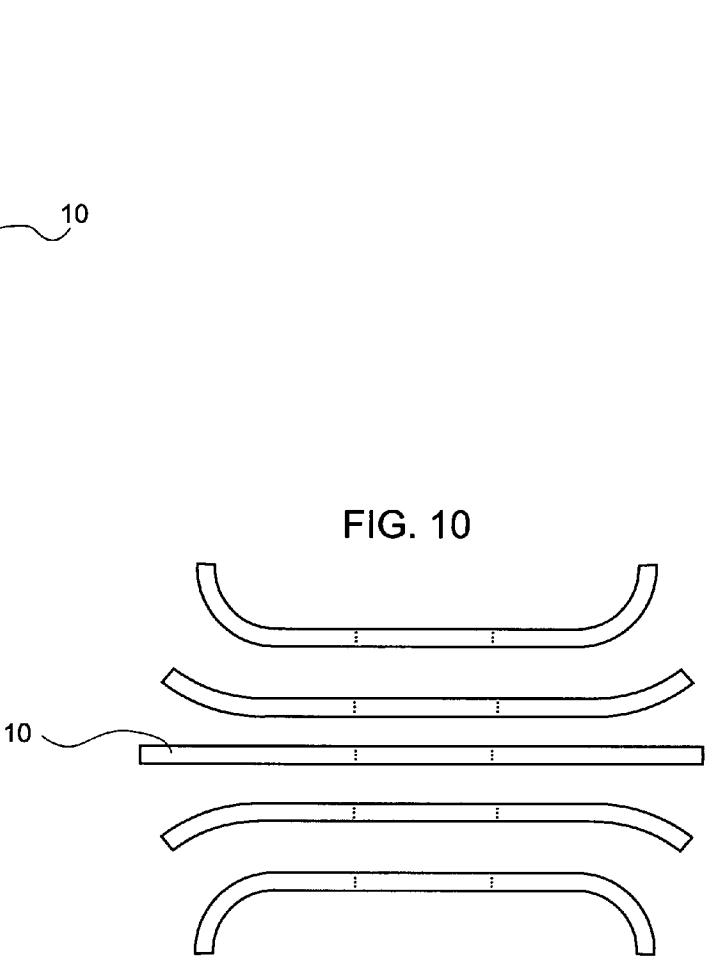
FIG. 10 shows concave and convex edges on the guide

FIG. 10 depicts several variations of concave or convex shapes that may be bent, molded or hinged just along the edge of the guide (10) to accommodate individual stroke techniques and preferences.

Figure 11:
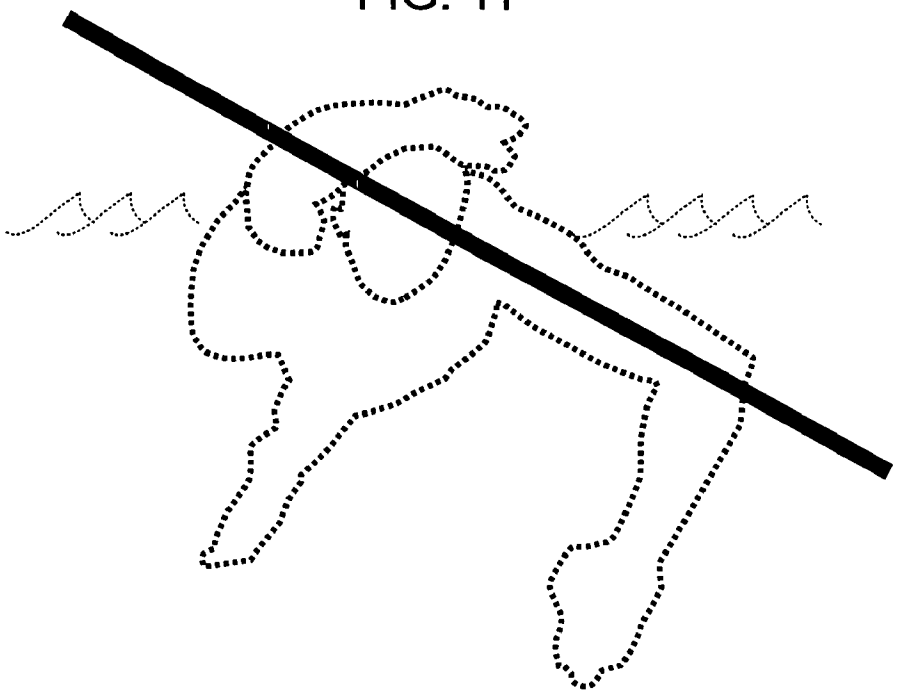
FIG. 11 shows arm angles relative to the shoulder plane in water

FIG. 11 depicts the arm angles of the swimmer relative to the shoulder plane during body roll while swimming.

Figure 12:
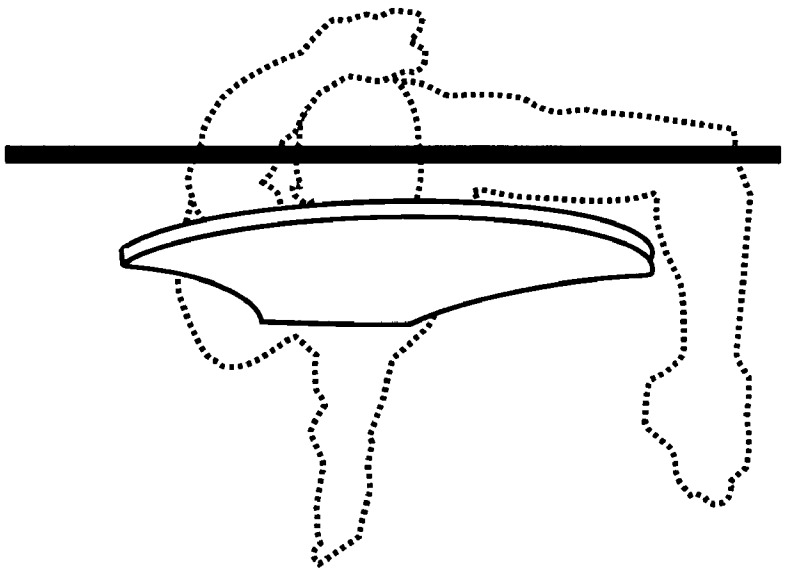
FIG. 12 shows arm angles relative to the shoulder plane with the guide

FIG. 12 depicts the arm angles of the swimmer relative to the shoulder plane when the swimmer uses the guide (10) in a prone position.

Figure 13:
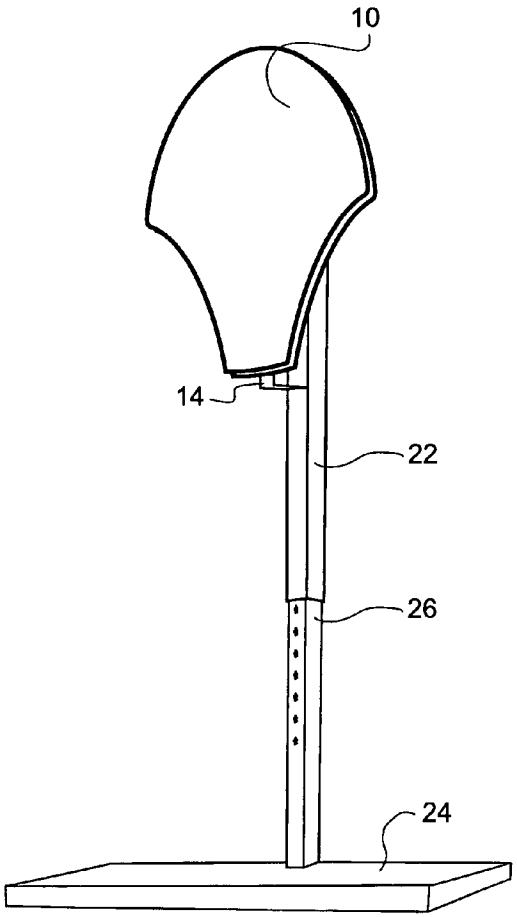
FIG. 13 shows the guide affixed to a vertical stand

FIG. 13 depicts the guide (10) affixed to an optionally preferred vertical stand (22) for use in an upright position. The stand consists of a platform (24) for the feet and a adjustable vertical pole (26) to adjust the height of the guide (10). The guide (10) is attached to the stand (22) and may include hardware such as a clamp or bracket (14) to allow the guide to be easily removable.

Figure 14:
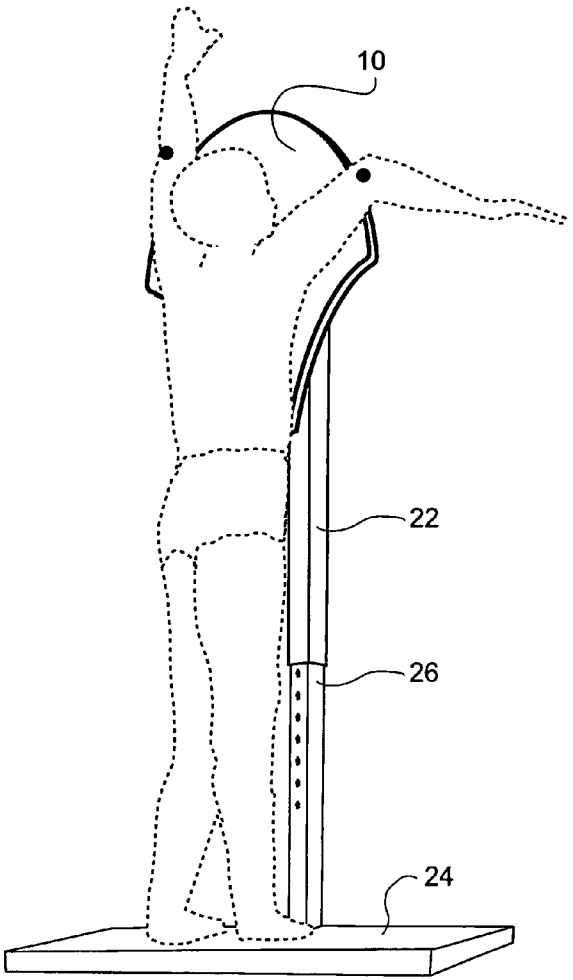
FIG. 14 shows a swimmer while using the guide on a vertical stand

FIG. 14 depicts a swimmer using the guide (10) affixed to a horizontal stand (22) for use in a vertical position.

Figure 15:
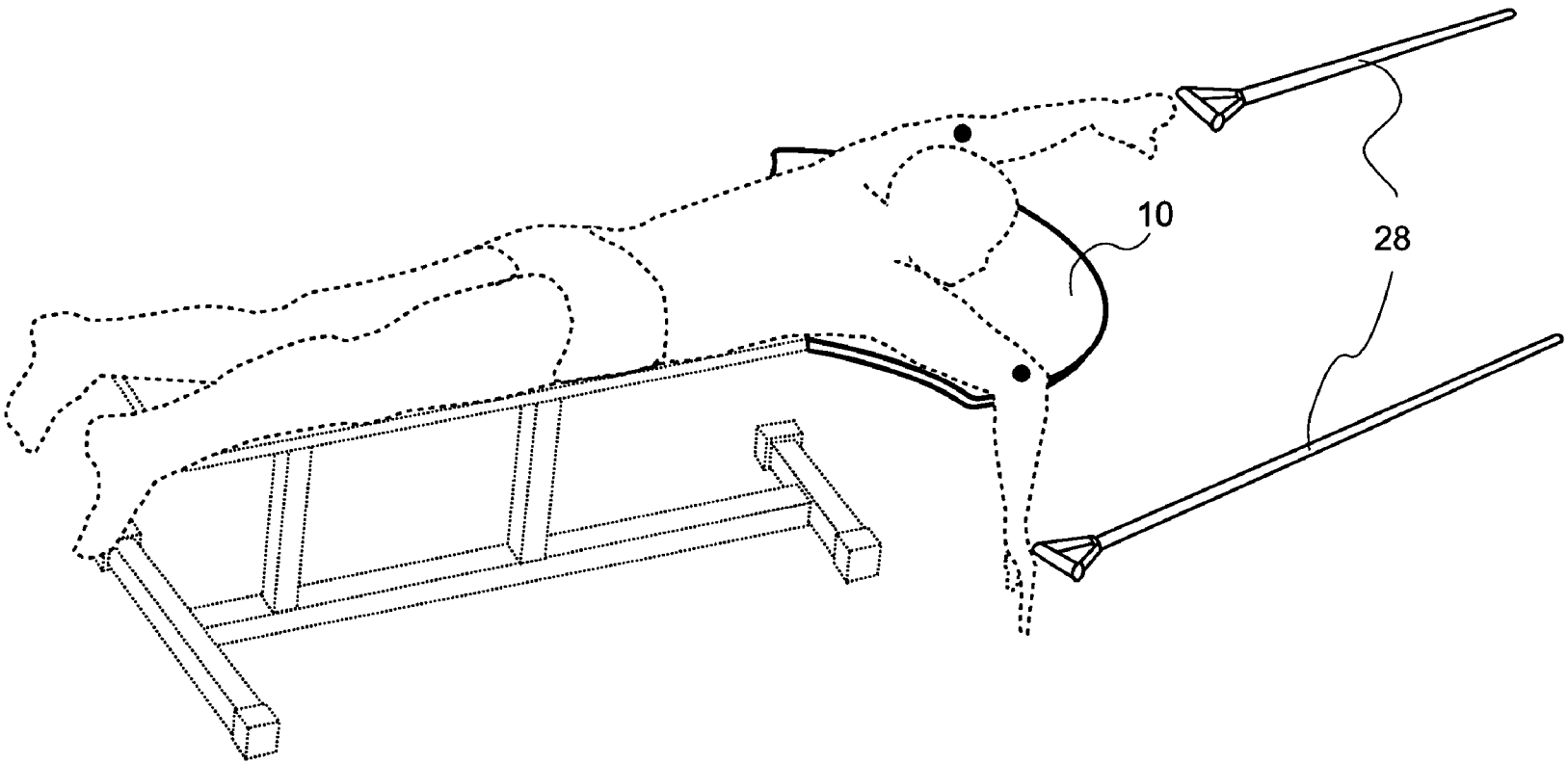
FIG. 15 shows a swimmer while using the guide with tubing

FIG. 15 depicts how a swimmer using the guide (10) in combination with the resistive force of rubber tubing (28) for swim training.

While the invention has been particularly shown and described with reference to preferred embodiments, it will be understood by those skilled in the art that various changes in form and detail may be made therein without departing from the spirit and scope of the invention.

I claim:

1. A guide for training the high elbow arm motion for swimming, comprising:

(a) a flat substantially rigid board;

(b) a means to define the path of an arm;

(c) a means to flex when pressed upon and return to original shape when released;

(d) a means for attachment to conventional prone or inclined benches;

(e) a means for attachment to a vertical stand.

2. A guide for training the high elbow arm motion for swimming, comprising:

(a) a concave substantially rigid board;

(b) a convex substantially rigid board;

(c) a means to define the path of an arm;

(d) a means to flex when pressed upon and return to original shape when released;

(e) a means for attachment to conventional prone or inclined benches;

(f) a means for attachment to a vertical stand.

3. A guide for training the high elbow arm motion for swimming, comprising:

(a) a flat substantially rigid board with concave edges;

(b) a flat substantially rigid board with convex edges;

(c) a flat substantially rigid board with hinged edges;

(d) a means to flex when pressed upon and return to original shape when released;

(e) a means for attachment to conventional prone or inclined benches;

(f) a means for attachment to a vertical stand.

4. A guide for training high elbow arm motion for swimming, comprising:

(a) a flat, concave or convex substantially rigid board with a cut-away potion on the exterior thereof that allows a swimmer to complete a stoke under a torso;

(b) a flat concave or convex substantially rigid board with the center cut away to enhance air circulation during use.

5. A swim training method using a guide attached to a conventional bench to train a swimmer to maintain a high elbow at a catch and through a stroke cycle:

(a) positioning the swimmer on said guide;

(b) pulling rubber tubing to encounter varied forces similar to those encountered while stroking in water;

(c) moving an arm of the swimmer so that it follows an outline of said guide including a cut-away portion thereof; and (d) completing said stoke cycle of said arm of the swimmer underneath the swimmer's torso.

6. An apparatus adapted for training a high elbow arm motion for swimming, comprising:

a first curvilinear portion defining a path an arm will travel while using said apparatus with an apex located near a medial line of said apparatus;

curvilinear cut away portions adjoining said first curvilinear portion, and further defining said path said arm will travel while using said apparatus such that said arm completes its motion nearer said medial line than at an intersection of said first curvilinear portion and said curvilinear cut away portions.

7. The apparatus of claim 6, further comprising attachment means for attaching said apparatus to a support.

8. The apparatus of claim 7, wherein said support is a bench.

9. The apparatus of claim 7, wherein said support is a stand.

10. The apparatus of claim 6, further comprising a central cut away.

11. The apparatus of claim 6, wherein said apparatus has a flat substantially rigid configuration.

12. The apparatus of claim 6, wherein said apparatus has a concave substantially rigid configuration.

13. The apparatus of claim 6, wherein said apparatus has a convex substantially rigid configuration.

14. The apparatus of claim 11, wherein said apparatus has concave edges.

15. The apparatus of claim 11, wherein said apparatus has convex edges.

16. The apparatus of claim 11, wherein said apparatus has hinged edges.

17. The apparatus of claim 11, wherein said apparatus is flexibly compliant such that the apparatus flexes when pressed upon and returns to original configuration when released.

18. The apparatus of claim 12, wherein said apparatus is flexibly compliant such that the apparatus flexes when pressed upon and returns to original configuration when released.

* * * * *